United States Patent [19]

Moriki et al.

[11] 4,445,833

[45] May 1, 1984

[54] SPINNERET FOR PRODUCTION OF COMPOSITE FILAMENTS

[75] Inventors: Yoshikazu Moriki; Masafumi Ogasawara, both of Otsu, Japan

[73] Assignee: Toray Industries, Inc., Tokyo, Japan

[21] Appl. No.: 349,697

[22] Filed: Feb. 17, 1982

[30] Foreign Application Priority Data

Feb. 18, 1981 [JP] Japan ..... 56-21505

[51] Int. Cl.[3] ..... D01D 3/00

[52] U.S. Cl. ..... 425/131.5; 264/171; 425/382.2

[58] Field of Search ..... 425/382.2, 463; 264/171

[56] References Cited

U.S. PATENT DOCUMENTS

| | | | |
|---|---|---|---|
| 3,197,812 | 8/1965 | Dietzsch et al. | 425/382.2 |
| 3,500,498 | 3/1970 | Fukuma et al. | 264/171 |
| 3,540,080 | 11/1970 | Goossens | 425/382.2 |
| 4,165,556 | 8/1979 | Nishida et al. | 28/162 |
| 4,370,114 | 1/1983 | Okamoto et al. | 264/171 |

FOREIGN PATENT DOCUMENTS

| | | | |
|---|---|---|---|
| 2055070 | 5/1971 | France . | |
| 2058144 | 5/1971 | France . | |
| 43-28771 | 12/1968 | Japan | 264/171 |
| 44-7374 | 4/1969 | Japan | 425/131.5 |
| 47-32134 | 8/1972 | Japan | 264/171 |
| 47-39726 | 10/1972 | Japan | 264/171 |
| 48-33415 | 10/1973 | Japan | 264/171 |
| 48-43562 | 12/1973 | Japan | 425/461 |
| 55-22045 | 2/1980 | Japan | 264/171 |
| 55-93813 | 7/1980 | Japan | 264/171 |
| 55-148214 | 11/1980 | Japan | 264/171 |
| 55-158332 | 12/1980 | Japan | 264/171 |
| 56-4707 | 1/1981 | Japan | 264/171 |
| 1313767 | 3/1970 | United Kingdom . | |
| 1326244 | 8/1970 | United Kingdom . | |
| 1325776 | 2/1971 | United Kingdom . | |

*Primary Examiner*—Jay H. Woo

*Attorney, Agent, or Firm*—Austin R. Miller

[57] ABSTRACT

An improved spinneret for use in producing composite filaments, comprises: nozzles for feeding at least an island constituent melt; a combining chamber having a horizontal bottom surface, into which chamber a sea constituent melt is introduced, the combining chamber having discharging outlets for the sea melt in combination with the respective nozzles, each combination being connected to an outlet for extruding a primary composite melt stream of a "core in sheath" type or a secondary composite melt stream of an "islands in a sea" type. The improvement being in that the combining chamber has feeding holes at the bottom surface thereof for the sea melt, in such an arrangement that the feeding holes are located substantially uniformly over the entire bottom surface of the combining chamber, and the extruding outlets are grouped into respective groups, each group having the same number of extruding outlets and the extruding outlets in each group are located equiangularly along a circle, whereby each circle has the same diameter, the respective circles having centers at which the feeding holes are located and being substantially equally spaced apart from the neighboring circles.

32 Claims, 9 Drawing Figures

SPINNERET FOR PRODUCTION OF COMPOSITE FILAMENTS

BACKGROUND OF THE INVENTION

The present invention relates to an improved spinneret for use in producing composite filaments, particularly the so-called "islands-in-a-sea" type synthetic composite filaments or "core-in-sheath" type synthetic composite filaments.

The term "islands-in-a-sea" type composite filaments used herein refers to filaments, whereby each mono-filament consists of at least two synthetic polymeric filamentary constituents incorporated into a filament body, with a plurality of filamentary island constituents being substantially embedded in a filamentary seal constituent. The island constituents are independent from each other and extend axially over the length of the filament. In view of the cross-sectional profile of the "islands-in-a-sea" type, the island consituents are located as a plurality of islands in the sea consituent, which appears as a sea, and this profile is substantially retained throughout the length of the composite filament.

The term "core-in-sheath" type composite filaments used herein refers to filaments, whereby each mono-filament consists of a synthetic polymeric filamentary constituent with another kind of filamentary constituent being substantially embedded in the former constituent. Such a filament may be referred to as a "primary composite filament". The above mentioned "islands in a sea" type filament may be referred to as a "secondary composite filament".

It is well known that such an "islands-in-a-sea" type composite filament is used to form a bundle of filaments having a very fine denier, which consists of only the island constituents when the sea constituent is removed from the composite filament. In this respect, such composite filaments are well known as material, in the form of filaments or staples, to be used in valuable non-woven fabrics, woven fabrics or knit goods.

In connection with this, it has been noted that attaining a higher density of the island constituents distributed in the sea constituent implies that a lesser amount of the sea constituent is to be removed from the composite filament, and, thus, becomes economically very advantageous. Further, in a case of the composite filaments having a considerable high density of the island constituent relative to the sea constituent, such filaments are, in practice, advantageous for the reason that they are available as finish filaments, without being subjected to the sea removing process. This is because in this case they can exhibit adequetely inherent characteristics of the island constituents through the thin covering sea constituent.

In this respect, many attempts of spinning "islands-in-a sea" type composite filaments having a high density of the island constituents have been made recently. In these attempts, it has been noted that, as the proportion of the sea constituent is reduced, production of desirable composite filaments rely on how the island constituents are distributed uniformly, in a cross-sectional view, in the sea constituent by using a spinneret. However, in the case of a composite filament having a considerably large proportion of the island constituents relative to the sea constituent, particularly in an extreme case where the sea constituent is reduced to be of the minimum proportion necessary to separate the island constituents from each other so that most of the cross-sectional of the composite filament is occupied by the island constituents, it is very difficult to produce, with assurance, such composite filaments for a long period of time by using the spinneret, while maintaining a uniform distribution of the island constituents in the sea constituent. In this case, according to the prior art, the following difficulties have been encountered. For example, referring to FIG. 1 shown in an axial cross-sectional view of a conventional spinneret, the spinneret has inlet holes 8 through which primary composite streams, of a simple core-in-sheath form, each consisting of a stream of a sea constituent polymer melt A and a stream of an island constituent polymer melt B embedded therein, are produced. The spinneret has uniting chambers 9, in which the primary composite streams are united to form secondary composite streams, and has extruding outlets or orifices 10 connected to the respective uniting chambers, through which the secondary composite streams are extruded.

According to the spinneret as shown in FIG. 1, while spinning composite filaments for a long period of time, it was noted that many cases occurred, in practice, wherein the island constituent streams, to be separated from each other in the united sea constituent stream, were partially fused with each other and/or the island constituents streams were exposed or disclosed partially from the circular surfaces of the secondary composite streams or the resultant filaments. In extreme cases, the resultant filaments had sections having a cross-sectional profile consisting almost entirely of either the sea constituent A or the island constituent B.

Such defective phenomena were likely to occur as the ratio of the island constituent B to the sea constituent A was increased.

Under the circumstances, the inventors investigated the defective phenomena and have found that they result from the unstable flow of the core-in-sheath type streams, that is, of the primary composite streams. Referring to FIG. 1, the defective phenomena occur due to a difference in the flow rates between the sea constituent melts A, which flow from a combining chamber 5 to the extruding outlets 10*a* and 10*b* through the corresponding uniting chambers 9, which outlets 10*a* and 10*b* are positioned in an outer circumferential zone and an inner circumferential zone, respectively, in a cross-sectional view.

This is because it is considered that the sea constituent melts A travel for different periods of time with different thermal hysteresis, until they are extruded from the outlets 10*a* and 10*b*, respectively, with the result that the apparent viscosities of the melts become different from each other.

In the above processes of the sea constituent melts A, the sea constituents streams become incompletely united, in a cross sectional view, and also have different diameters, in a cross-sectional view, and, thus, as time lapses, there may occur cases where a part of the sea constituent melt A is replaced by the island constituent, in a cross-sectional view, and in an extreme case it may occur that only the island constituent B occupies the entire cross-sectional area, that is, the longitudinal sections of the secondary composite stream are occupied by the island constituent B.

SUMMARY OF THE INVENTION

An object of the present invention is to provide a spinneret which overcomes the above mentioned defects of the prior art and thus is effectively used for producing "islands-in-a-sea" type composite filaments with a high island constituent density, wherein the island constituent streams are substantially embedded in a sea constituent stream in such a manner that they are uniformly distributed and separated from each other in a cross-sectional view, the spinneret being able to uniformly extrude composite streams for a long period of time, which become the above composite filaments.

Another object of the present invention is to provide a spinneret for producing "core-in-sheath" type composite filaments having substantially the same dimensions in a cross-section and having the sheaths, surrounding the cores, of substantially the same thickness.

According to one aspect of the present invention, there is provided a spinneret for use in producing composite filaments, each filament consisting of at least first and second constituents extending axially, the spinneret extruding composite melt streams, which are to become corresponding composite filaments, each respective composite melt stream comprising a predetermined number of first streams of the first constituent melt, which first streams are united, and the same number of second streams of the second constituent melt, which second streams are embedded in respective first streams, the spinneret having first passages formed therein through which the first constituent melt is forced to pass to form the respective first streams and having second passages formed therein through which the second constituent melt is forced to pass to form the respective second streams, said first and second passages becoming partially combined to produce respective primary composite streams, each primary composite stream having a first stream with a second stream embedded therein, as defined above, and then to produce respective secondary composite streams referred to as "composite melt streams", as above.

In the above spinneret, the improvement is that said first passages, in combination with the second passages, allow each of the first constituent melts to travel substantially the same distance thereby to form, in combination with the second constituent melts, respective secondary composite streams while exerting substantially the same resistance against the flowing of the streams on each of the first consituent melts.

The spinneret preferably may comprise: an upper horizontal plate provided with groups of vertical inlet nozzles extending downwardly for the second melt, each group consisting of the same number of said inlet nozzles; a lower horizontal plate having groups of vertically extending inlet holes formed therein, the groups corresponding to the respective nozzle groups, and: a control spacer and a peripheral spacer, in combination, forming a cylindrical spacer located between said upper and lower plates. Each of said inlet holes paired with a corresponding inlet nozzle extending thereinto to form a circumferential space for passage of the first constituent melt, said space having a length less than the entire length of said inlet hole thereby to produce the primary composite stream. The spinneret further comprises: a combining chamber for the first constituent melt being defined by a combination of said upper and lower plates, said inlet nozzles and said cylindrical spacer, and; plate member having uniting chambers formed therein of a funnel form projecting downwardly, and having extruding outlets formed at the lower ends of said uniting chambers and extending axially and downwardly for extruding respective secondary composite streams therethrough. Said inlet holes paired with corresponding inlet nozzles in each group extend downwardly to open to a corresponding uniting chamber.

In the above spinneret, said first passage comprise vertical holes extending upwardly to open to the bottom circumferential surface of said combining chamber, said vertical holes being equally spaced apart from the neighbouring holes and being distributed substantially uniformely over the entire circumferential surface.

Said uniting chambers are incorporated into groups, each group consisting of the same number of uniting chambers which are located equiangularly around one of said vertical holes and along one of circles on a horizontal plane coaxial with the uniting chamber. Said circles have the same diameter and are equally spaced apart from the neighbouring ones.

Said first passages preferably further comprise: vertical inlet passages located equiangularly along a circle on a horizontal plane coaxial with the spinneret and extending downwardly; a horizontal circular passage formed along said circle and connected to the lower ends of said vertical inlet passages, and; distributing passages extending from said circular passage at respective equiangular positions thereof and forming horizontal passages connected to the lower ends of the respective vertical holes. Lengths of the respective horizontal passages between said circular passage and the lower ends of the respective vertical holes are substantially the same.

Preferably, each horizontal passage consists of a distributing passage and one of the branch passages forming a group, each being branched from the forward end of said distributing passage and being connected to one of said vertical holes in the corresponding group.

According to another aspect of the present invention, there is provided a spinneret for use in producing composite filaments, which comprises: nozzles for feeding at least an island constituent melt; a combining chamber having a horizontal bottom surface, into which chamber a sea constituent melt is introduced, the combining chamber having discharging outlets for the sea melt in combination with the respective nozzles, each combination being connected to an outlet for extruding a composite melt stream. The improvement is in that said combining chamber has feeding holes at the bottom surface thereof for the sea melt, in such an arrangement that said feeding holes are located substantially uniformly over the entire bottom surface of said combining chamber, and said extending outlets are grouped into respective groups, each group having the same number of extruding outlets and said extruding outlets in each group are located equiangularly along a circle, whereby each circle has the same diameter, the respective circles having centers at which said feeding holes are located and being substantially equally spaced apart from the neighbouring circles. In the above spinneret said extruding outlet extends upwardly and may be integrated with said discharging outlet to extrude a "core in sheath" type composite melt stream consisting of the sea melt with the island melt substantially embedded therein.

Alternatively, the above spinneret further may comprise uniting chambers, each being connected to a group of said discharging outlets, whereby each group has the same number of discharging outlets, and being integrated with said extruding outlet, wherein a primary composite melt stream of a "core in sheath" type consisting of the sea melt with the island melt substantially embedded therein is produced by each discharging outlet in combination with said nozzle, and a secondary composite melt stream of an "islands in a sea" type consisting of primary composite melt streams united is produced in said uniting chamber.

DESCRIPTION OF THE DRAWINGS

In FIGS. 1, 3, 6 and 9, inlet nozzles, inlet or feeding holes uniting chambers and extruding outlets formed in the spinnerets are indicated with enlarged profiles compared with those of the other elements for the sake of convenience.

PREFERRED EMBODIMENTS OF THE INVENTION

Figure 1:
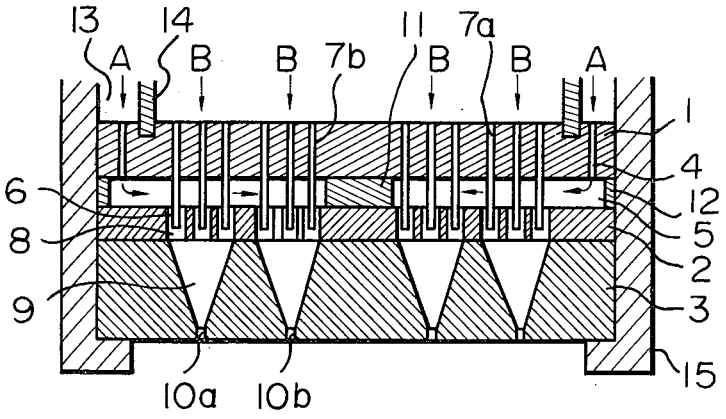
FIG. 1 shows a cross-sectional view indicating a conventional spinneret for use in producing "islands-in-a-sea" type composite filaments.

Referring to FIGS. 2, 3, 4, 5, 6 and 7, a spinneret of the present invention comprises an upper horizontal plate 21 provided with groups of vertical inlet nozzles 27 extending downwardly for a sea constituent melt A. Each nozzle group consists of the same number of inlet nozzles 27. A lower horizontal plate 22 is provided. The plate 22 has groups of vertically extending inlet holes 28 formed therein. The hole groups correspond to the respective nozzle groups. A central spacer 31 and a peripheral spacer 32 are provided to form, in combination, a cylindrical spacer located between the upper plate 21 and the lower plate 22. Each of the inlet holes 28 is paired with a corresponding inlet nozzle 27, in such a manner that each nozzle extends into the inlet hole 28 in a coaxial relationship. The inlet nozzle and the inlet hole in combination form a circumferential space 26 for passage of the first or sea constituent melt A. The space 26 is designed so as to have an axial length less than the entire length of the inlet hole 28. The lower portion of the inlet hole 28, into which the nozzle 27 does not extend, produces a primary composite melt stream consisting of the sea melt stream, which flows from a combining chamber 25 of a circumferential form, explained in detail below, through the circumferential space 26, and the island melt stream which flows into the sea melt through the inlet nozzle 27.

The combining chamber 25 for the sea melt is defined by a combination of the upper plate 21, the lower plate 22, the inlet nozzles 27 and the cylindrical spacer. The spinneret further comprises a plate member having uniting chambers 29 formed therein. The plate member consists of an upper plate piece 23 and a lower plate piece 23', in contact with each other.

Each uniting chamber 29 is of a funnel form projecting downwardly, and has an extruding outlet or orifice 30 formed at the lower end of the uniting chamber 29 and extending axially and downwardly. Each group of the inlet holes 28 paired with corresponding inlet nozzles 27 extend downwardly to open to a corresponding uniting chamber 29. The primary composite melt streams in each group flow into a corresponding uniting chamber 29 to form a united stream, that is, a secondary composite melt stream to be extruded from the extruding outlet 30. In the secondary stream, separated island melt streams are distributed and embedded in a combined sea melt stream.

The upper plate 21, the lower plate 22 and the plate member consisting of the upper plate piece 23 and the lower plate piece 23' are combined by means of a circular covering wall 20.

The above arrangement of the spinneret, according to the present invention, is substantially the same as that of the conventional spinneret as shown in FIG. 1, except for the plate member.

In FIG. 1, 1 denotes a corresponding upper plate, 2 denotes a corresponding lower plate, 3 denotes a corresponding plate member consisting of a single plate, 6 denotes a corresponding circumferential space, 7*a* and 7*b* denotes corresponding inlet nozzles, 8 denotes corresponding inlet holes, 5 denotes a corresponding circumferential combining chamber, 9 denotes corresponding uniting chambers, 10*a* and 10*b* denote corresponding extruding outlets, 11 denotes a corresponding central spacer, 12 denotes a corresponding peripheral spacer and 15 denotes a corresponding covering wall. The conventional spinneret shown in FIG. 1 has first passages for the sea melt A comprising vertical holes 4 formed in the upper plate 1. The holes 4 extend downwardly to open to the circumferential combining chamber 5. The vertical holes 4 are located in a peripheral or outer circumferential zone of the upper plate 1 and are spaced apart from the neighbouring holes along a circle on a horizontal plane in the outer zone. The first passages further comprise a circular passage 13 defined by the covering wall 15 and an inner circular wall 14 extending upwardly from the upper surface of the upper plate 1. The inner circular wall 14 is along a circle on a horizontal plane, within which circle the inlet nozzles 7*a* and 7*b*, the inlet holes 8, the uniting chambers 9 and the extruding outlets 10*a* and 10*b* are located. The extruding outlets 10*a* and 10*b*, with the corresponding inlet holes 8 and inlet nozzles 7*a* and 7*b*, form two kinds of groups, i.e. outer groups and inner groups. The outlets 10*a* in the outer group are located along an outer circle, within the above mentioned circle of the inner circular wall 14, and are spaced apart from the neighbouring outlets. The extruding nozzles 10*b* in the inner group are located along an inner circle within the outer circles and are spaced apart from the neighbouring nozzles. The inner circular wall 14, the above outer circle and the inner circle are coaxial with the spinneret or the covering wall 15.

As mentioned above, the first passages for the sea melt A are formed by: the circular passage 13; the holes 4 which open thereto; the combining chamber 5; the inlet holes 8 in combination with the inlet nozzles 7*a* and 7*b;* the uniting chambers 9 and; the extruding outlets 10*a* and 10*b*.

Contrary to the above, the spinneret of the present invention, as shown in FIGS. 2, 3, 4, 5, 6 and 7, has corresponding first passages formed therein which, in combination, form: vertical inlet passages 24, preferably at least three, most preferably six passages; a horizontal circular passage 40; horizontal distributing passages 41; groups of horizontal branch passages 43; groups of vertical branch passages 45; the circumferential combining chamber 25; the inlet holes 28 in combination with the inlet nozzles 27; the uniting chambers 29, and; the extruding outlets 30.

The vertical inlet passages 24 have the same dimensions and extend downwardly. They are located along a first circle I, on a horizontal plane, coaxial with the spinneret, and are equally spaced apart from the neighbouring vertical inlet passages.

The horizontal circular passage 40 lies on the first circle I and is connected to the lower ends of the vertical inlet passages 24.

The horizontal distributing passages 41 have the same dimensions and are preferably of the same number as the vertical inlet passages 24. Each distributing passage extends outwardly from the circular passage 40 and is equally spaced apart from the neighbouring distributing passages. Preferably, each distributing passage extends, as shown in the figures, from a circular arc of the circular passage 40 between the neighbouring vertical inlet passages 24 at a center of the arc.

Each group of the horizontal branch passages 43 consists of the same number of passages branched from the forward ends 44 of the respective distributing passages 41, and radially extends equiangularly.

Figure 7:
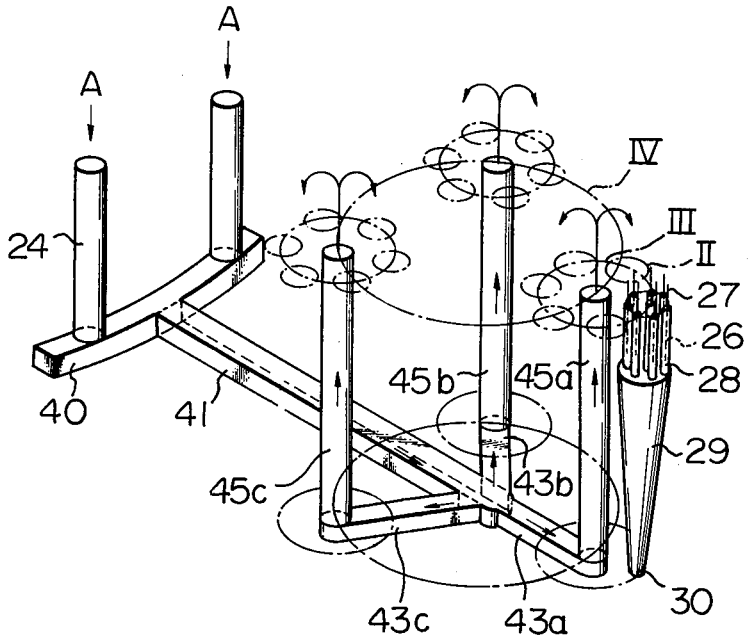
FIG. 7 shows a perspective diagrammatical view partially indicating passages for the sea constituent melt, formed in the spinneret shown in FIGS. 2 and 3.

Each group of the horizontal branch passages 43 consists preferably of three passages which are narrower than the distributing passage 41, as shown in FIG. 7, i.e. passages 43*a*, 43*b* and 43*c*, and all may have the same dimensions.

Each group of the vertical branch passages 45 consists of the same number of passages extending upwardly from the forward ends of the respective horizontal branch passages 43 in the corresponding group. The vertical branch passages 45 may have the same dimensions, as shown in the figures. They are connected to the combining chamber 25 to form feeding holes at the bottom thereof.

In the above mentioned arrangement of the spinneret according to the present invention, the inlet holes 28 paired with the corresponding inlet nozzles 27 therein in each group are located on and/or a second circuit II, on a horizontal plane, coaxial with the uniting chamber 29 and the extruding outlet 30. Each vertical branch passage 45 is coaxial with a third circle III, on a horizontal plane and is located at a center of the third circle. The extruding outlets 30 in each group are located equiangularly along the third circle III. The vertical branch passages 45 in each group are located equiangularly along a fourth circle IV on a horizontal plane. The forward ends 44 of the horizontal branch passages 43 are located equiangularly along a fifth circle V on a horizontal plane. The fifth circle V is coaxial with the first circle and has a diameter larger than that of the first circle.

Each horizontal distributing passage 41 may extend radially from the circular passage 40 to reach a sixth circle VI, on a horizontal plane, coaxial with the circular passage 40 and then extends straight-forward in a direction inclined a predetermined angle relative to the radial direction.

Figure 2:
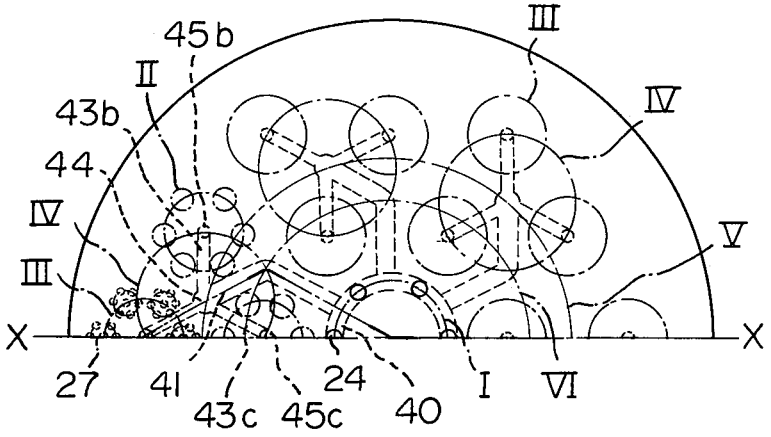
FIG. 2 shows a lateral cross-sectional view indicating an embodiment of a spinneret, according to the present invention, for use in producing "islands-in-a-sea" type composite filaments, the view indicating half of the spinneret with a circular covering wall.

The inlet holes 28 paired with the corresponding inlet nozzles 27 in each group are located equally spaced apart from the neighbouring ones. Preferably, the inlet holes 28 in combination with the corresponding inlet nozzles 27 in each group are located one at a center of the second circle II and the others equiangularly along the second circle II, as shown in FIG. 2.

Figure 3:
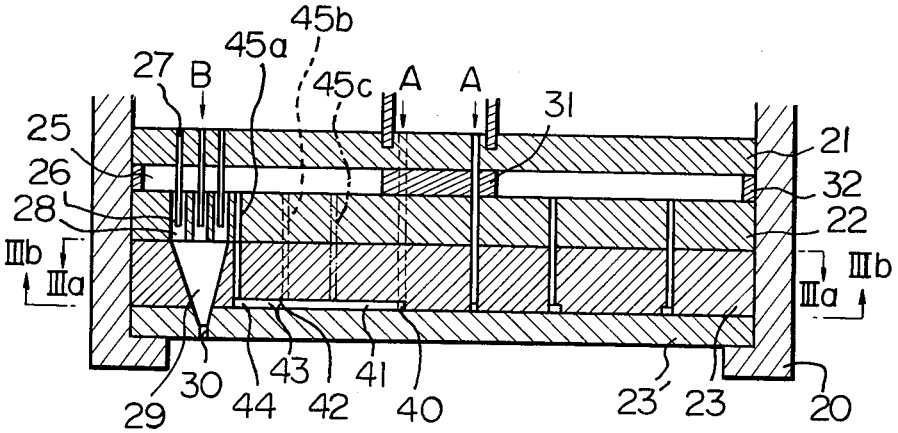
FIG. 3 shows a cross-sectional view of the spinneret shown in FIG. 2, and corresponds to FIG. 1 above, the view being taken along a line X—X in FIG. 2.

The above mentioned horizontal circular passage 40, horizontal distributing passages 41 and horizontal branch passages 43 are defined by the inner surfaces of the upper and lower plate pieces 23 and 23' with horizontal grooves formed either on one or on both of the inner surfaces. Preferably, these horizontal passages 40, 41 and 43 are defined by a flat inner surface of the lower plate piece 23' and grooves formed on a flat inner surface of the upper plate piece 23, as shown in FIG. 3.

The vertical inlet passages 24 are defined by vertical holes formed in the upper plate piece 23, the lower plate 22, the central spacer 31 and the upper plate 21. The vertical branch passages 45 are defined by vertical holes formed in the upper plate piece 23 and the lower plate 22. The vertical holes form the feeding holes at the upper surface of the lower plate 22.

According to the spinneret of the present invention, the sea melts A having the same flow rate are introduced into the respective vertical inlet passages 24. The introduced sea melts reach the circular passage 40 and then are combined therein. The combined sea melt A is distributed from the distributing passages 41 to become separate sea melts having the same flow rate. Each of the separated sea melts A flows through the distributing passage 41 to reach the forward end 44 thereof. The sea melt A is distributed substantially uniformly into the three vertical branch passages 45*a*, 45*b* and 45*c* in a group to become separated sea melts having substantially the same flow rate. The distributed sea melts are forced to flow upwardly through respective vertical branch passages 45, 45*a*, 45*b* and 45*c* and flow into the circumferential combining chamber 25. Each flow of the sea melts is likely to flow radially into the combining chamber 25 from the upper end of the vertical branch passage 45 having the feeding hole 45*a*, 45*b* or 45*c* and thus is distributed uniformly into the respective second circle II. As a result, each second circle II is liable to receive substantially the same flow rate of the sea melt. In each second circle II, the inlet holes 28 located within the circle are likely to receive substantially the same flow rate of the sea melt. The received sea melts A are forced to pass through the circumferential space 26 to form cylindrical sea melt streams, while the island melt B is uniformly distributed into the respective inlet nozzles 27. Each cylindrical sea melt stream in the inlet nozzle becomes combined with a corresponding island melt fed from the nozzle, thereby forming a primary composite stream in which the island melt is embedded and this primary composite stream extends axially at a central portion thereof. The produced primary composite streams flow into a uniting chamber 29, thereby coming to be united with each other, in such an arrangement, in a cross-sectional view, that they are uniformly distributed, to form a united stream. The united stream in each uniting chamber 29 is then extruded through an extruding outlet 30 to form a secondary composite stream of the "islands-in-a-sea" type.

The arrangement of the first passages of the prior art, as shown in FIG. 1, does not allow each of the sea constituent melts A to travel substantially in the same distance until the sea melts flow from the circular passage 13 and are extruded from the extruding outlets 10*a* and 10*b*. Particularly, there are substantial differences in the lengths travelled and, thus, in the travel times of period between two cases. In one case, the sea melt is forced to pass through the outer extruding outlet 10*a*, and in the other case the sea melt is forced to pass through the inner extruding outlet 10*b*. Further, a substantial difference occurs in the resistances exerted on the melts A against the flow passing through the outer extruding outlet 10*a* and the inner extruding outlet 10*b*. Such differences lead to a considerable difference in the thermal hysteresis between a sea constituent stream extruded from the outer extruding outlet 10*a* and a sea constituent stream extruded from the inner extruding outlet 10*b*. As a result, there is a considerable difference in the viscosities between the outer sea stream and the inner sea stream.

This viscosity difference causes a difference in flow rates between the outer sea stream and the inner sea stream. Therefore, the defective phenomena regarding the composite streams or fibers occurs, as mentioned above.

In marked contrast, the arrangement of the first passages formed in the spinneret of the present invention assuredly allows each of the sea constituent melts to travel substantially the same distance from the inlets of the sea melts A until the sea melts are extruded from the respective extruding outlets 30, while the first passages exert substantially the same resistance against the flowing of the streams of the sea melts A. Thus, the residence times of the melts are substantially the same and the flow rates of the melts in the first passages are substantially the same. Further, the apparent viscosities of the melts are substantially the same at the corresponding points of respective first passages. Therefore, continuous production of "islands-in-a-sea" composite filamentary streams, having a desirable cross-sectional profile, wherein the island constituent streams are distributed in a sea constituent stream with each island stream being separated from the neighbouring ones, is ensured for a long period of time without the necessity of replacing the spinneret.

This is due to the following reasons: according to the first passage arrangement of the present invention described above, the forward ends 44 of the horizontal branch passages are equivalent as a starting or initial position of the sea melt A introduced. In other words, each of the sea melts A, which has reached the forward ends of respective horizontal branch passages 43, remain under the same conditions regarding the flow rate, the viscosity, the flow resistance and the thermal hysteresis.

Further, the first passage arrangement of the present invention allows the vertical branch passages 45 in all of the groups to be designed so that they are located on a circumferential horizontal plane defined by the circumferential combining chamber 25 in such an arrangement that they are uniformly distributed on the circumferential plane and, thus, are equally spaced apart from the neighbouring vertical branch passages. Further, the first passage arrangement allows the third circles III to be designed so that the circles are uniformly distributed on the circumferential plane and, thus, the circles III are equally spaced apart from the neighbouring ones.

Figure 4:
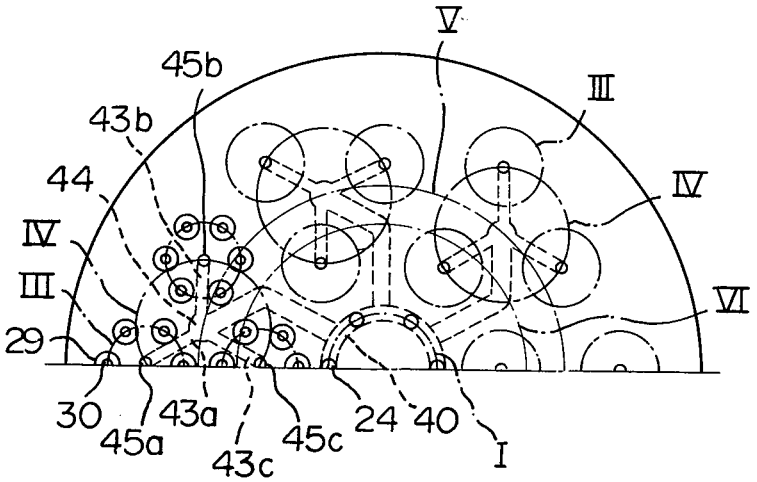
FIG. 4 shows a lateral cross-sectional view of half of the spinneret shown as in FIG. 3, but with the covering wall deleted and corresponds to that of FIG. 2, the view being taken along a line Y—Y in FIG. 3 and being depicted in the downward direction as indicated by arrows.
Figure 5:
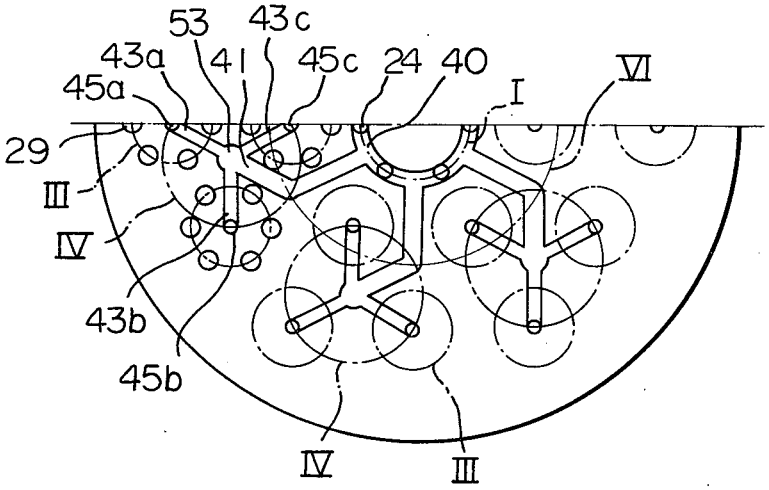
FIG. 5 shows a lateral cross-sectional view of the same half portion of the spinneret as that of FIG. 2, but with the covering wall deleted, the view being taken along another line Z—Z in FIG. 3 and being depicted in the upward direction as indicated by arrows.
Figure 6:
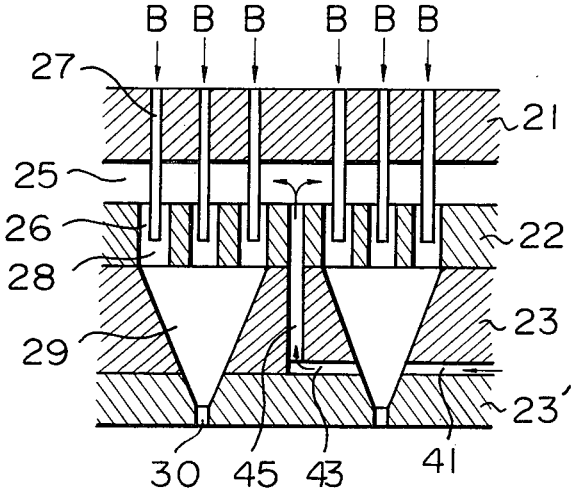
FIG. 6 shows an enlarged partial cross-sectional view of the spinneret shown in FIG. 3, indicating, in detail, inlet holes in combination with inlet nozzles for producing primary composite melt streams and the flowing of the sea constituent melt around the inlet holes.

In the present embodiment of the spinneret, the above designs were made, as being apparent from FIGS. 2, 4 and 5. Therefore, the first passages allow each of the sea melts A having substantially the same flow rate to travel substantially the same distance for substantially the same period of time, thereby to form, in combination with the island melts B, respective secondary composite streams, while exerting substantially the same resistance against the flowing of the streams on each of the first melts A. Therefore, the spinneret of the present invention can overcome the defects of the conventional spinneret in producing "islands-in-a-sea" type composite filaments.

The present invention is not limited to the arrangements mentioned above. For example, the present invention covers a spinneret extruding "islands-in-a-sea" type composite filaments, each consisting of a sea constituent and a plurality of different kinds of island constituents. Further, the present invention is not limited to the horizontal circular passage 40, the horizontal distributing passages 41 and the horizontal branch passages 43 (43*a*, 43*b* and 43*c*) formed in the flat pieces 23 and 23'. They may be formed in another portion of the spinneret in such a manner that they do not obstruct the flowing of the island melts. Still further, the present invention is not limited to the vertical inlet passages 24 formed, as vertical holes, in the upper plate 21, the central spacer 31, the lower plate 22 and the upper plate piece 23. They may be formed in a peripheral zone of the spinneret. In this case, the horizontal distributing passages may be designed so that they extend inwardly radially from the circular passage 40 toward a center of the first circle I, as shown in FIGS. 8 and 9.

Figure 8:
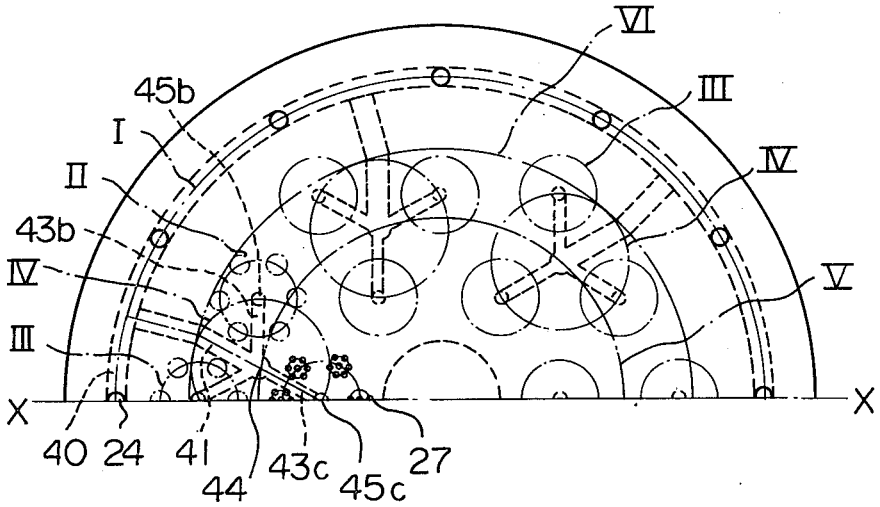
FIG. 8 shows a lateral cross-sectional view of another embodiment of the spinneret according to the present invention, the view corresponding to that of FIG. 2.
Figure 9:
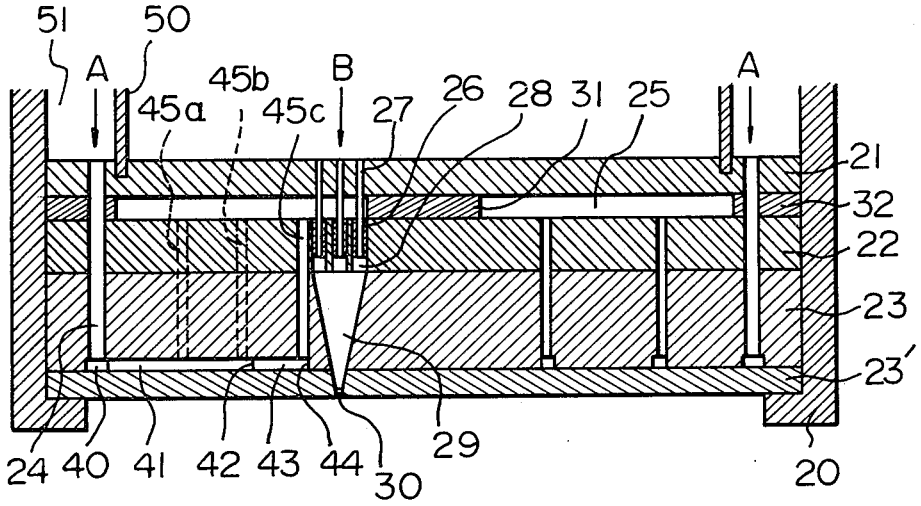
FIG. 9 shows a cross-sectional view of the spineret shown in FIG. 8, the view corresponding to that of FIG. 3 and being taken along a line X—X in FIG. 8.

Referring to FIGS. 8 and 9, the same numerals denote the same elements as or elements corresponding to those in FIGS. 2, 3, 4, 5, 6 and 9, and 50 denotes an inner wall corresponding to the inner wall 14 in FIG. 1. The outer circular covering wall 20, the inner wall 50 and the surface of the upper plate 21, in combination, form a circular passage 51 corresponding to the passage 13 in FIG. 1. The vertical inlet passages 40 are connected to open to the circular passage 51, and located equiangularly along a first circle I, as shown in FIG. 8. In this embodiment, the number of the distributing passages 41 is larger than that of the vertical inlet passages 24, and two distributing passages are located between each pair of neighbouring inlet passages and equally spaced apart from the neighbouring inlet passage and the neighbouring distributing passage.

Further, referring to FIGS. 3 and 7, an inlet hole 28 paired with a inlet nozzle 27, located at the center of the circle II may remain as it is, while the other inlet holes paired with inlet nozzles are left out with a uniting chamber 29 modified so that an extruding outlet 30 is integrated with the remaining inlet hole 28. By this modification, each extruding outlet 30 can extrude a "core-in-sheath" type composite melt stream consisting of a sea melt stream with a single island melt stream embedded therein.

Still further, in place of the vertical inlet passages 24 and the circular passage 40, a single inlet passage, forming a vertical hole extending downwardly along the axis of the spinneret through the upper plate 21, the central spacer 31, the lower plate 22 and the upper plate piece 23, may be provided. In this modification, the distributing passages 41 extend from the single inlet passage at respective equiangular positions along the circumference of the inlet passage at the lower end thereof.

The following example is given for the purpose of illustrating the advantages of the present invention in comparison with a control.

EXAMPLE

"Islands-in-a-sea" type composite filaments were prepared from an island constituent polymer of polyethylene terephthalate having a melt viscosity of 3000 poise at 280° C. (determined by using flow tester) and a sea constituent polymer of polystyrene under the respective conditions as follows.

Condition 1: L/S=80/20

Condition 2: L/S=90/10

Condition 3: L/S=95/5

L: a feeding rate of the island polymer melt per unit time to be fed into a spinneret.

S: a feeding rate of the sea polymer melt per unit time to be fed into the spinneret.

The spinneret used is that as shown in FIGS. 2, 3, 4, 5, 6 and 7 in the following arrangement:

The number of the vertical inlet passages 24 (located equiangularly along the first circle I): 6

The number of the distributing passages 41 (each extending from an arc of the circular passage 40 between the neighbouring vertical inlet passages 24 at a center of the arc.): 6

The number of the horizontal branch passages 43 in each group: 3

The number of the extruding outlets or orifices 30 per unit horizontal branch passage 43: 6

The number of the inlet nozzles 27 per unit extruding outlet 30: 36

CONTROL

The corresponding "islands-in-a-sea" type composite filaments were prepared by using a spinneret as shown in FIG. 1, with the same materials and under the same conditions as those of the example above, except for the following arrangement conditions.

The number of the extruding outlets 10 located along six coaxial circles, each circle having the outlets located equiangularly: 108

The number of the inlet passages or vertical holes 4 located equiangularly along a circle: 40

The number of the inlet nozzles 7a and 7b per unit extruding outlet 10: 36

The example and control were carried out at an extruding temperature 290° C. under the respective conditions 1, 2 and 3 for 40 hours. The results are indicated in Table I below.

TABLE I

| | | Example | Control |
|---|---|---|---|
| | | Spinneret Used | |
| Conditions | L/S | That of Present Invention | Conventional One |
| 1 | 80/20 | ◎ | ○ |
| 2 | 90/10 | ○ | Δ |
| 3 | 95/5 | ○ | X |

◎: A case where the number (n) of island streams which were united per unit extruding outlet is less than ¼, and a ratio (N) of the number of the island streams which were united to the total number of the extruding outlets is less than 5%.
○: A case where n is not less than ¼, and N is less than 5%.
Δ: A case where n is not less than ¼ and N is not less than 5% but less than 10%.
X: A case where n is not less than ¼ and N is not less than 10%.

In the above symbol definitions, the term "streams which were united" implies a phenomenon in which island streams from the inlet nozzles 27 were not covered completely by the respective sea streams in the inlet hole 28 and, thus, the incompletely covered island streams came to be united with each other in the uniting chamber 29.

What is claimed is:

1. In a spinneret for use in producing composite filaments, each filament consisting of at least first and second constituents extending axially, the spinneret having an axis and extruding composite melt streams, which are to become corresponding composite filaments, each respective composite melt stream comprising a predetermined number of first streams of the first constituent melt, and the same number of second streams of the second constituent melt, which second streams are embedded in the respective first streams, the spinneret having first passages formed therein, through which the first constituent melt is forced to pass to form the respective first streams, and having second passages formed therein, through which the second constituent melt is forced to pass to form the respective second streams, said first and second passages becoming partially combined to produce the respective primary composite streams, each primary composite stream having a first stream with a second stream embedded therein, as defined above, and then to produce respective secondary composite streams, referred to as "composite melt streams", the improvement being in that (A) each of said first passages is comprised of:

(i) a common combining chamber for the first constituent melt, having upper and lower inner flat surfaces;

(ii) an upstream passage portion having substantially the same length as that of any other first passage from the first constituent melt provided outside of the spinneret to said combining chamber and forming a feeding hole at the same one of the surfaces of said combining chamber; and (iii) a uniting chamber having an axis parallel to the axis of the spinneret and forming at least an inlet hole at its upper end for introducing the first and second constituent melts at the lower inner surface of said combining chamber and an extruding outlet at its lower end for extruding a composite melt stream;

(B) said extruding outlets contain at least a pair of outlets which are different radial distances from the axis of the spinneret;

(C) said extruding outlets are grouped so that each group consists of at least one extruding outlet and is paired with a respective one of said feeding holes; and (D) the axis of each extruding outlet in each group is spaced radially apart from the paired feeding hole at substantially the same distance as that of any other extruding outlet in the same group and as that in any other group, whereby said first passages, in combination with the second passages, allow each of the first constituent melts to travel substantially the same distance thereby to form, in combination with the second constituent melts, respective secondary composite streams while exerting substantially the same resistance against the flowing of the streams of each of the first constituent melts.

2. A spinneret as claimed in claim 1, comprising: an upper horizontal plate provided with groups of vertical inlet nozzles extending downwardly for the second melt, each group consisting of the same number of said inlet nozzles; a lower horizontal plate having groups of vertically extending inlet holes formed therein, the groups corresponding to the respective nozzle groups; a central spacer and a peripheral spacer, in combination, forming a cylindrical spacer located between said upper and lower plates, each of said inlet holes being paired with a corresponding inlet nozzle extending therein to form a circumferential space for passage of the first constituent melt, said space having a length less than the entire length of said inlet hole, thereby to produce the primary composite stream; said combining chamber for the first constituent melt being defined by a combination of said upper and lower plates, said inlet nozzles and said cylindrical spacer; plate member having said uniting chambers formed therein of a funnel form projecting downwardly, and having said extruding outlets formed at the lower ends of said uniting chambers and extending axially and downwardly for extruding the respective secondary composite streams therethrough, said inlet holes paired with the corresponding inlet nozzles in each group extending downwardly to open to a corresponding uniting chamber, wherein said first passages, in combination, form: at least three vertical inlet passages of the same dimensions extending downwardly and located along a first circle, on a horizontal plane, coaxial with the spinneret, and equally spaced apart from the neighbouring ones; a horizontal circular passage along said first circle, connected to the lower ends of said vertical inlet passages; horizontal distributing passages of the same dimensions, each extending from said circular passage and equally spaced apart from the neighbouring ones; groups of horizontal branch passage, each group consisting of the same number of passages branched from the forward ends of the respective distributing passages and radially extending equiangularly; groups of vertical branch passages, each group consisting of the same number of passages extending upwardly from the forward ends of the respective horizontal branch passages, said vertical branch passages being connected to said combining chamber to form said feeding holes at the bottom thereof; said combining chamber; said inlet holes in combination with said inlet nozzles; said uniting chambers, and; said extruding outlets.

3. A spinneret as claimed in claim 2, wherein: said plate member includes upper and lower pieces of plates in contact with each other, and; said horizontal circular passage, said horizontal distributing passages and said horizontal branch passages are defined by the inner surfaces of said upper and lower plate pieces with horizontal grooves formed either on one or on both of said inner surfaces.

4. A spinneret as claimed in claim 3, wherein said distributing passages extend outwardly from said first circle, and said vertical inlet passages are defined by vertical holes formed in said upper plate piece, said lower plate, said central spacer and said upper plate, while said vertical branch passages are defined by vertical holes formed in said upper plate piece and said lower plate.

5. A spinneret as claimed in claim 4, wherein the number of said distributing passages are the same as that of said vertical inlet passages.

6. A spinneret as claimed in claim 5, wherein the number of said vertical inlet passages is six, and each horizontal distribution passages extends from a circular arc of said circular passage between the neighbouring vertical inlet passages at a center of said arc.

7. A spinneret as claimed in claim 2 wherein each group of said horizontal branch passages consists of three passages which are narrower than said distributing passage.

8. A spinneret as claimed in claim 6, wherein said horizontal branch passages have the same dimensions, and said vertical branch passages have the same dimensions.

9. A spinneret as claimed in claim 3, wherein said distributing passages extend inwardly from said first circle, and said vertical inlet passages are defined by vertical holes formed in said upper plate piece, said lower plate, said peripheral spacer and said upper plate while said vertical branch passages are defined by vertical holes formed in said upper plate piece and said lower plate.

10. A spinneret as claimed in claim 2, wherein: said inlet holes, paired with corresponding inlet nozzles therein in each group, are located within a second circle, on a horizontal plane, said circle being coaxial with said uniting chamber and said extruding outlet; each vertical branch passage is coaxial with a third circle, on a horizontal plane and is located at a center thereof, and said extruding outlets in each group are located equiangularly along said third circle; said vertical branch passages in each group are located equiangularly along a fourth circle on a horizontal plane, and; the forward ends of said horizontal branch passages are located equiangularly along a fifth circle, on a horizontal plane, said fifth circle being coaxial with said first circle.

11. A spinneret as claimed in claim 10, wherein each horizontal distributing passage extends radially from said circle passage to reach a sixth circle, on a horizontal plane, coaxial with said circular passage and then extends straight-forward in a direction inclined a predetermined angle relative to the radial direction.

12. A spinneret as claimed in claim 10, wherein said inlet holes, paired with corresponding inlet nozzles in each group, are located equally spaced apart from the neighbouring holes in said second circle.

13. A spinneret as claimed in any one of claims 10, 11 or 12, wherein said inlet holes, paired with corresponding inlet nozzles in each group, are located one at a center of said second circle and the others along one or more coaxial circles.

14. A spinneret as claimed in claim 10, wherein said third circles are equally spaced apart from the neighbouring circles.

15. A spinneret as claimed in claim 1, comprising: an upper horizontal plate provided with groups of vertical inlet nozzles extending downwardly for the second melt, each group consisting of the same number of said inlet nozzles; a lower horizontal plate having groups of vertically extending inlet holes formed therein, the groups corresponding to the respective nozzle groups; a central spacer and a peripheral spacer, in combination, forming a cylindrical spacer located between said upper and lower plates, each of said inlet holes being paired with a corresponding inlet nozzles extending thereinto to form a circumferential space for passage of the first constituent melt, said space having a length less than the entire length of said inlet hole thereby to produce the primary composite stream; said combining chamber for the first constituent melt being defined by a combination of said upper and lower plates, said inlet nozzles and said cylindrical spacer; plate member having said uniting chambers formed therein of a funnel form projecting downwardly, and having said extruding outlets formed at the lower ends of said uniting chambers and extending axially and downwardly for extruding the respective secondary composite streams therethrough, said inlet holes paired with corresponding inlet nozzles in each group extending downwardly to open to a corresponding uniting chamber, wherein said first passage comprise vertical holes extending upwardly to open to the bottom circumferential surface of said combining chamber, thereby to form said feeding hole, said vertical holes being equally spaced apart from the neighbouring holes and being distributed substantially uniformly over the entire circumferential surface.

16. A spinneret as claimed in claim 15, wherein said uniting chambers are incorporated into groups, each group consisting of the same number of uniting chambers which are located equiangularly around one of said vertical holes along one of the circles, on the horizontal plane, being coaxial with the hole, said circles having the same diameter and being equally spaced apart from the neighbouring circles.

17. A spinneret as claimed in claim 16, wherein said first passages further comprise: vertical inlet passages located equiangularly along a circle, on a horizontal plane, coaxial with the spinneret and extending downwardly; a horizontal circular passage formed along said circle and connected to the lower ends of said vertical inlet passages, and; distributing passages extending from said circular passage at respective equiangular positions thereof and forming horizontal passages connected to the lower ends of the respective vertical holes, lengths of the respective horizontal passages between said circular passage and the lower ends of respective vertical holes being substantially the same.

18. A spinneret as claimed in claim 17, wherein each horizontal passage consists of one of said distributing passages and one of branch passages forming a group, each being branched from the forward end of said distributing passage and being connected to one of said vertical holes in the corresponding group.

19. A spinneret as claimed in claim 16, wherein said first passages further comprise: a single vertical inlet passage extending downwardly along the axis of the spinneret; distributing passages extending from said single inlet passage at respective equiangular positions along the circumference and forming horizontal passages connected to the lower ends of the respective vertical holes, lengths of the respective horizontal passages between said single inlet passage and the lower ends of respective vertical holes being substantially the same.

20. A spinneret as claimed in claim 19, wherein each horizontal passage consists of one of said distributing passages and one of branch passages forming a group, each being branched from the forward end of said distributing passage and being connected to one of said vertical holes in the corresponding group.

21. In a spinneret, for use in producing composite filaments, comprising (a) nozzles for feeding at least an island constituent melt;

(b) a combining chamber having a horizontal bottom surface, into which chamber a sea constituent melt is introduced, (c) the combining chamber having discharge outlets for the sea melt in combination with the respective nozzles, (d) pluralities of discharge outlet-nozzle combinations being connected to an outlet for extruding a composite melt stream, the improvement being in that (e) said combining chamber has feeding holes at the bottom surface thereof for the sea melt, in such an arrangement that said feeding holes are located substantially uniformly over the entire bottom surface of said combining chamber, and (f) said extruding outlets include at least a pair of outlets at different radial distances from the axis of the spinneret and grouped into respective groups, each group having the same number of extruding outlets and said extruding outlets in each group being located equiangularly along a circle, whereby each circle has the same diameter, the respective circles having centers at which said feeding holes are located and being substantially equally spaced apart from the neighboring circles.

22. A spinneret as claimed in claim 21, wherein said extruding outlet extends upwardly and is integrated with said discharging outlet to extrude a "core in sheath" type composite melt stream consisting of the sea melt with the island melt substantially embedded therein.

23. A spinneret as claimed in claim 21, further comprising uniting chambers, each being connected to a group of said discharging outlets, whereby each group has the same number of discharging outlet, and being integrated with said extruding outlet, wherein a primary composite melt stream of a "core in sheath" type consisting of the sea melt with the island melt substantially embedded therein is produced by each discharging hole in combination with said nozzle, and a secondary composite melt stream of an "islands in a sea" type consisting of primary composite melt streams united is produced in said uniting chamber.

24. A spinneret as claimed in claim 22, wherein said feeding holes extend downwardly, the spinneret further comprising: a single vertical inlet passage extending downwardly along the axis of the spinneret; horizontal distributing passages extending from said single inlet passage at respective equiangular positions along the circumference thereof and forming horizontal passages connected to the lower ends of the respective feeding holes, lengths of the respective horizontal passages between said single inlet passage and the lower ends of said feeding holes being substantially the same.

25. A spinneret for producing axially elongated composite filaments having first and second axially extending constituents, said first constituent being concentric about said second constituent in said filament, comprising:

a. a plurality of groups of nozzles for producing primary composite streams having said second constituent axially extending therewithin and said first constituent concentric thereabout, each nozzle including:
(i) a plurality of central conduits for discharge of said second constituent therethrough via outlet orifices therein; and
(ii) passageway means having discharge orifices concentrically spaced about said central conduits outlet orifices for delivering said first constituent concentrically about said second constituent to from said primary composite stream;
nozzles of each group being symmetrically arranged within the group;
b. said passageway means of said nozzles communicating at their inlet ends with a common first constituent chamber;
c. uniting chambers, communicating with said outlet and discharge orifices of nozzles of respective groups, for receiving and combining primary composite streams produced by respective groups of nozzles;
d. said uniting chambers having orifice means for extruding therefrom respective combined primary composite streams as secondary composite streams defining said axially elongated composite filaments; and
e. supply means for providing said first constituent to said common chamber via a plurality of supply orifices opening into said common chamber at common symmetrical positions with respect to nozzles of each group.

26. The spinneret of claim 25 wherein said supply means further includes a plurality of supply conduits, of common dimension, terminating as said supply orifices opening into said common chamber at said common symmetrical positions with respect to nozzles of each group.

27. The spinneret of claim 26 wherein respective supply orifices are at common distances in said common chamber from nozzles of a respective group.

28. The spinneret of claim 27 wherein
(a) said spinneret has an axis extending in the direction of elongation of said filaments,
(b) said central conduits and said passageway means parallel said axis;
(c) said groups of nozzles are at a plurality of radial distances from said axis;
(d) nozzles constituting each group are symmetrically disposed about a group axis parallel said spinneret axis;
(e) said supply orifices are located to discharge said first constituent symmetrically into said common chamber with respect to nozzle in each nozzle group.

29. The spinneret of claim 28 wherein respective supply orifices are aligned with said group axes of respective nozzle groups.

30. The spinneret of claim 29 wherein said conduits pass through said common chamber.

31. The spinneret of claim 29 wherein nozzles of at least one of said groups are located at least at three different distances from the spinneret axis.

32. The spinneret of claim 25 wherein nozzle groups of said plurality are located at least at three different distances from the spinneret axis.

* * * * *